US007100780B1

(12) United States Patent
VanCalbergh et al.

(10) Patent No.: US 7,100,780 B1
(45) Date of Patent: Sep. 5, 2006

(54) DISPLAY ASSEMBLY

(75) Inventors: Kandice VanCalbergh, Prairie Grove, IL (US); Jay Jones, Evergreen, CO (US)

(73) Assignee: GFX International, Inc., Grayslake, IL (US)

( * ) Notice: Subject to any disclaimer, the term of this patent is extended or adjusted under 35 U.S.C. 154(b) by 0 days.

(21) Appl. No.: 10/907,222

(22) Filed: Mar. 24, 2005

(51) Int. Cl.
*A47F 3/08* (2006.01)
*E05D 15/10* (2006.01)

(52) U.S. Cl. ..... 211/94.01; 49/127; 49/211; 49/410

(58) Field of Classification Search ..... 312/128–32, 312/321; 211/189, 94.01, 94.02; 49/370, 49/128, 130, 152, 158, 163, 410, 125, 127, 49/211, 404, 434
See application file for complete search history.

(56) References Cited

U.S. PATENT DOCUMENTS

| | | | | |
|---|---|---|---|---|
| 2,893,071 A | | 7/1959 | Oden | |
| 3,280,506 A | * | 10/1966 | Sandek et al. | 49/130 |
| 3,510,983 A | | 5/1970 | Barabas | |
| 3,636,661 A | * | 1/1972 | Strawsine | 49/413 |
| 4,482,066 A | * | 11/1984 | Dykstra | 211/151 |
| 4,565,031 A | | 1/1986 | Sakamoto | |
| 4,644,690 A | | 2/1987 | Caimi | |
| 5,924,577 A | * | 7/1999 | Gessert | 211/41.1 |
| 6,497,072 B1 | | 12/2002 | Fries | |
| 6,497,265 B1 | * | 12/2002 | Davis et al. | 160/87 |
| 6,860,064 B1 | * | 3/2005 | Bakalar | 49/127 |
| 2003/0070363 A1 | | 4/2003 | Bakalar | |
| 2003/0205002 A1 | | 11/2003 | Gradecki | |

FOREIGN PATENT DOCUMENTS

| | | |
|---|---|---|
| GB | 2169335 A | 7/1986 |

* cited by examiner

*Primary Examiner*—Jennifer E. Novosad
*Assistant Examiner*—Jared W. Newton
(74) *Attorney, Agent, or Firm*—Vedder Price Kaufman & Kammholz

(57) ABSTRACT

A display assembly including an upper channel, a lower channel and a plurality of display panels. The upper channel includes longitudinal first and second upper tracks oriented parallel and disposed immediately adjacent. The lower channel is disposed substantially vertically aligned with the upper channel and includes a longitudinal first lower track and a plurality of stall sets oriented substantially transverse to the first lower track such that each stall had an open end for communication with the first lower track. The display panels engage the upper and lower channels and include a frame and covering. The frame engages the upper and lower channels with a plurality of top and bottom guide elements. The covering is configured generally equivalent to a periphery of the frame and has an exterior surface for bearing at least a portion of a graphical representation. In a first operative position, the plurality of display panels are oriented coplanar and disposed nearly contiguous, thereby, cooperatively defining a continuous, uninterrupted graphical representation rendered over the plurality of display panels.

21 Claims, 6 Drawing Sheets

DISPLAY ASSEMBLY

BACKGROUND

The present disclosure relates to a display assembly for engaging a storage rack and more particularly, to an aesthetically pleasing display assembly which functions to conceal merchandise on the shelves with a continuous graphical representation, yet provides easy access thereto.

A storage rack generally referred to as a H-frame rack system is commonly used in large, high-ceilinged stores that sell various household home improvement and other high-volume products to the public. These H-frame rack systems are shown, for example, at FIGS. 6 and 7 of U.S. Pat. No. 5,918,750.

The H-frame rack systems generally include several substantially vertical posts. These posts may be installed into a base. Alternatively, and more typically, these vertical posts are permanently and rigidly attached to the concrete floor at these store. A number of substantially horizontal beams are connected to the vertical posts. Substantial horizontal shelves which may be of a grid-type or a solid-plate type structure are supported by the horizontal beams. Merchandise is placed upon these horizontal shelves.

Commonly, there are several vertically spaced-part horizontal beams, and several correspondingly vertically spaced-apart horizontal shelves. The lower-most shelves are at and below eye-level. Thus, merchandise that is placed upon these lower-most shelves is readily accessible to retail shoppers.

In contrast, the higher horizontal shelves are too high to permit shoppers to reach merchandise placed upon those shelves. In fact, the merchandise on these shelves is often not intended to be accessed by shoppers. Instead, such merchandise is intended to be the source of restocking when the merchandise on the lower level shelves has been sold.

In some instances, the more highly positioned merchandise is so far above eye-level that it cannot readily be seen by those shoppers. As a result, many retailers whose stores include H-frame rack systems place covers in front of the upper portion of these H-frame rack systems. Such covers obscure the highly positioned merchandise, providing the store with a cleaner, more uncluttered appearance.

One type of doors that are currently used for H-frame rack systems are pivoting doors. In two-door pivoting door structures, each door is hinged so that the door swings outwardly, like the doors of a typical barn. In one-door pivoting door structures, the door is hinged at its bottom, so that the door swings downwardly, like the tailgate of a pick-up truck. Alternatively, the door may be hinged at its top, so that it swings upwardly about a pivot point that is positioned above the door.

These pivoting kinds of prior art doors have certain disadvantages. The most significant disadvantage, is that these doors extend into the adjacent store aisle, i.e., the doors extend beyond a vertical plane extending between adjacent vertical posts of the H-frame rack system. Because doors opened in this manner can extend into the store aisle, they can be and have been struck, causing damage to the doors. For example, these doors can be damaged by passing forklifts, consumers with shopping carts containing tall merchandise, or by the portable, wheeled ladders that are commonly used by the workers in such stores to access the merchandise on the highest shelves. Such opened or damaged doors also create a risk to persons in their vicinity.

The prior art doors are also heavy. This increases the strain on the hinges that hold the doors, and increases the potential damage that can be done to objects or persons that strike them. The prior art doors are also subject to warpage, which can make them difficult or impossible to align. As a result, unsightly and uneven gaps can arise between doors.

Another prior art example of a door assembly includes a plurality of sliding doors. Rollers are secured the sliding doors to facilitate lateral movement along the openings of the H-frame rack system. Channels are positioned above the sliding doors and are secured to the horizontal beams. The rollers, and thus the doors are guided by the channels. Each of the doors in this assembly is parallel and laterally or horizontally offset with respect to each adjacent door. There are several disadvantageous with this prior art assembly. Namely, in the advertising display placed upon the doors which may extend for over more than one door is disrupted by the lateral or transverse offset between the panels. Accordingly, larger displays appear discontinuous, not aesthetically pleasing to the eye and distracting. Commercial advertising displayed in this manner is not flattering and turns off advertisers and customers.

Another disadvantage is that the doors are not secured along their bottom edge. As a result the doors are subject to dislodging upon unexpected impact and also may be subject to damage from improper use or unintended contact.

Therefore, there is a need in the art for a display assembly for H-frame rack systems that overcomes the deficiencies and disadvantageous of the prior art and is more secure, less complex, less costly, easier to use and manufacture and creates a more esthetically pleasing seamless display for graphical representations.

BRIEF DESCRIPTION OF THE DRAWINGS

Certain embodiments are shown in the drawings. However, it is understood that the present disclosure is not limited to the arrangements and instrumentality shown in the attached drawings, wherein.

DETAILED DESCRIPTION

Figure 1:
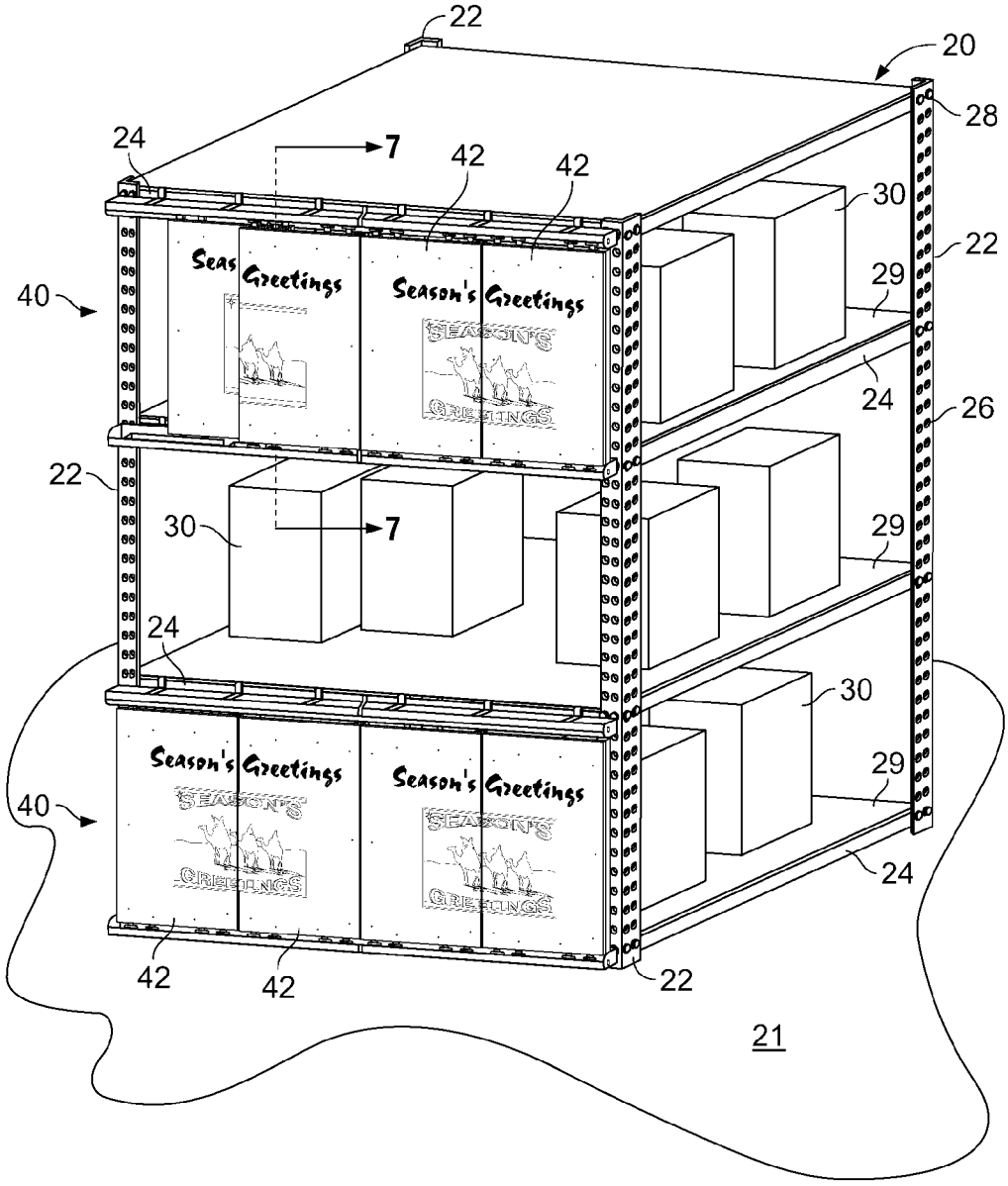
FIG. 1 illustrates a perspective view of a display assembly installed on a rack.

For the purposes of promoting and understanding the principles disclosed herein, reference will now be made to the preferred embodiments illustrated in the drawings and specific language will be used to describe the same. It will nevertheless be understood that no limitation of the scope is thereby intended. Such alterations and further modifications in the illustrated device and such further applications are the principles disclosed as illustrated therein as being contemplated as would normally occur to one skilled in the art to which this disclosure relates.

In accordance with one principle aspect to the present disclosure, a display assembly for engaging a rack includes an upper channel connected to one of the beams of the rack, a lower channel connected to another of the beams of the rack and a plurality of display panels. The upper channel includes first and second upper tracks oriented parallel and disposed immediately adjacent. The lower channel includes a first lower track and a plurality of stall sets oriented substantially transverse to the first lower track. The display panels engage the upper and lower channels and include a frame and covering. The frame includes a plurality of top and bottom guide elements and the covering is configured generally equivalent to the periphery of the frame so that an exterior surface thereof may bear a graphically representation so that the display panels disposed aligned in a first operative position cooperatively define a continuous, uninterrupted graphical representation rendered over the plurality of the display panels.

In another principle aspect of the present invention, a display assembly for engaging a rack includes an upper channel connected to one of the beams of the rack, a lower channel connected to another of the beams of the rack and a plurality of display panels moveably engaging the upper and lower channels. The upper channel includes top, side, and divider walls to cooperatively define first and second upper tracks which are oriented, parallel and disposed immediately adjacent. Openings in the divider walls define a passageway between the first and second upper track. The lower channel includes bottom, side and interior walls cooperatively define the first lower track substantially vertically aligned with the first upper track and the plurality of stall sets oriented substantially transverse to the first lower track. The bottom wall is disposed of oblique to the top wall.

In another principle aspect of the present invention, a display assembly for engaging a rack includes an upper channel connected to one of the beams of the rack, a lower channel connected to another of the beams of the rack, a plurality of display panels engaging the upper and lower channels and the bottom wall of the lower channel disposed oblique to the top wall of the upper channel.

FIG. 1 illustrates a perspective view of a plurality of display assemblies 40 installed on a rack 20. The H-frame rack 20 is commonly used in high-ceilinged, retail-warehouse type stores. As may be seen in FIGS. 1, 2, 6 and 7, the H-frame rack system 20 includes a plurality of substantially vertical posts 22 which are load-bearing members for the H-frame rack system 20. The vertical post 22 may be installed into a base. More typically, however, these vertical posts 22 are permanently and rigidly attached to the concrete floor at the stores in which they are used. A number of substantially horizontal beams 24 are connected to the vertical posts 22. The horizontal beams 24 are secured to the posts 22 with mounting hardware, including but not limited to, nuts and bolts, rivets or the vertical posts 22 may be formed with a plurality of apertures 26 therein which are engaged by mounting bosses 28 of the beams 24. The beams 24 and posts 22 form a strong, lightweight structure that serves as a platform on which to place merchandise 30.

The merchandise 30 is supported by substantially horizontal shelves 29. The shelves 29 may be of a grid-type or a solid plate-type, structure. As shown in FIG. 1, the shelves 29 are typically by, placed upon, and secured to the horizontal beams 24.

Commonly, there are two to four vertically spaced apart rows of horizontal beams 24 on each of the H-frame rack systems 20. There are a corresponding number of vertically spaced apart shelves 29. The lower-most shelves are either at the eye-level or below the eye-level of the typical shopper and adjacent the ground surface 21.

The more highly positioned horizontal shelves 29 of FIG. 1 are above the eye-level of the typical shopper and cannot be reached without a ladder or other suitable device. The merchandise 30 on these higher shelves 29 is often not intended to be accessed by shoppers. Instead, merchandise 30 on such higher shelves 29 is intended to be used for restocking the lower shelves when the merchandise at the lower levels is exhausted.

Figure 8:
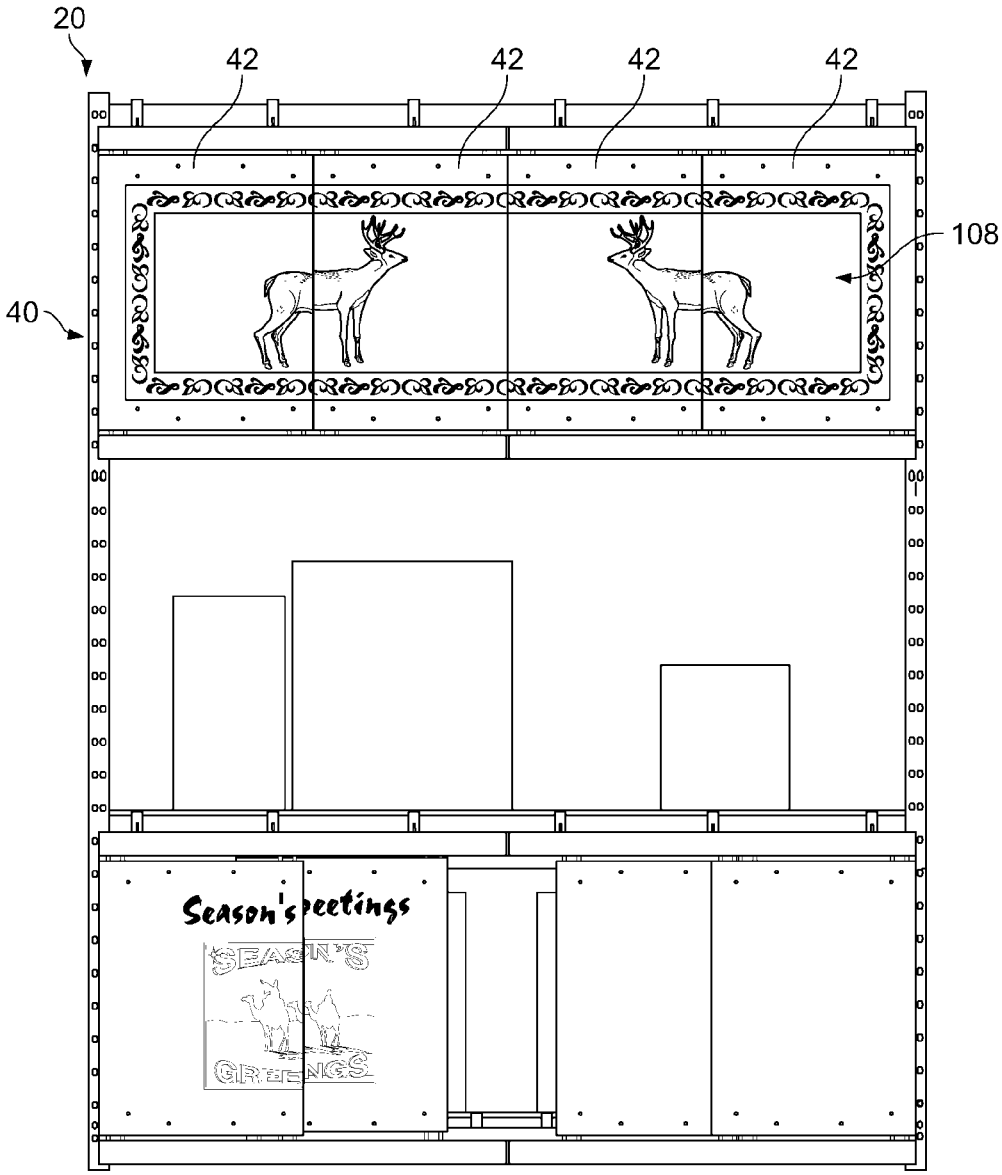
FIG. 8 illustrates an elevation view of another embodiment of the display assembly.

The display assemblies 40 of the present disclosure can be used on either the upper, middle or lower shelves of the H-frame rack system 20. It is within the teachings of the present disclosure that use of the display assemblies 40 may be used in connection with any combination of the upper, middle and lower shelves, as desired. In one embodiment, the display assembly 40 includes at least two display panels 42. However, it is within the teachings of the present disclosure that each display assembly 40 may include a plurality of display panels 42. For example, as best shown in FIG. 8, the display assembly 40 concealing the product present on the upper shelf of the H-frame rack system 20 includes four display panels 42, which in this FIG. 8 are oriented coplanar and disposed nearly contiguous, thereby cooperatively defining a continuous, uninterrupted graphical representation over the plurality of display panels.

Regardless of the number of display panels 42, the display assemblies 40 of the present invention are particularly advantageous in that the display panels 42, when concealing merchandise 30 on any shelf, are oriented coplanar and disposed nearly contiguous, thereby cooperatively defining continuous, uninterrupted graphical representation rendered over the plurality of display panels. This is particularly advantageous to manufacturers and the retailers who implement the display assemblies 40 of the present disclosure. The manufacturers may advertise on the display panels 42 any type of advertising, indicia or other graphical representation. The retailers may rent out the space available on the display panels 42 to the manufacturers or other local entities and thereby derive additional revenue from the display assemblies 40 of the present disclosure.

As may be seen in FIGS. 2–5, each display assembly 40 preferably includes an upper channel 50, a lower channel 60 and the aforementioned display panels 42. The upper channel 50 is adapted for connection to one of the beams 24. As may be observed in FIGS. 5–7, the upper channel 50 includes a plurality of brackets 52 that are connected to the upper channel 50 so that the upper channel 50 may engage to one of the beams 24. Preferably, a threaded fastener 54 engages a threaded aperture 55 formed in the bracket 52 to facilitate securing of the bracket 52 to the beam 24. It is within the teachings of the present invention that various other apparatus and methods may be used to facilitate removable connection of the bracket 52 to the beam 24. Preferably, a reinforcing element 56 is connected to adjacent normal portions of the bracket 52 to provide reinforcement thereof.

Figure 3:
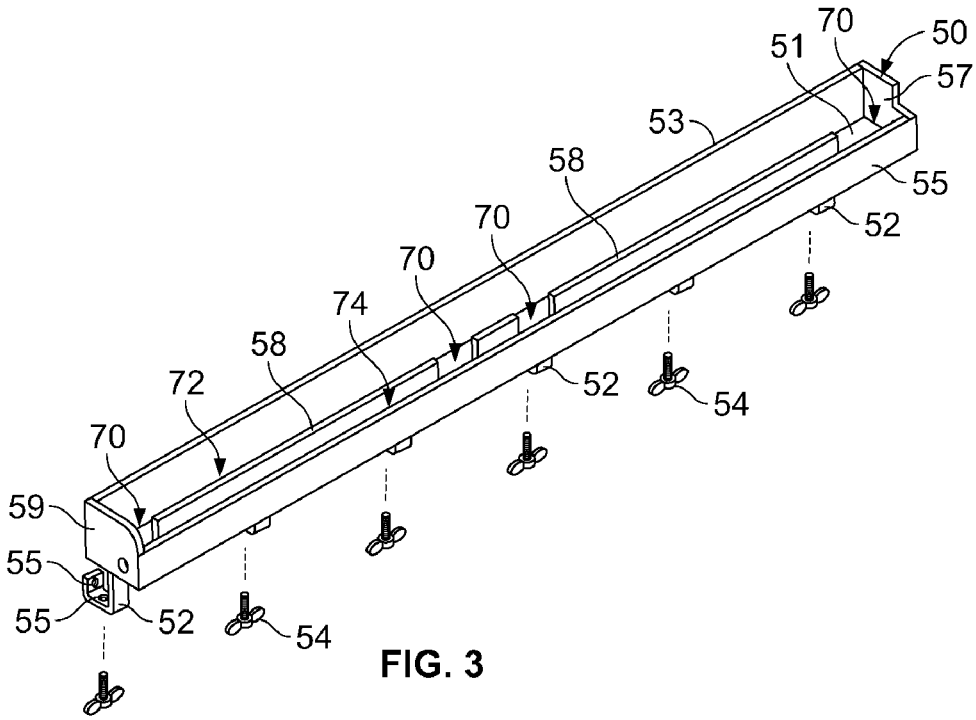
FIG. 3 illustrates a prospective view of an upper channel of the display assembly inverted for clarity.
Figure 4:
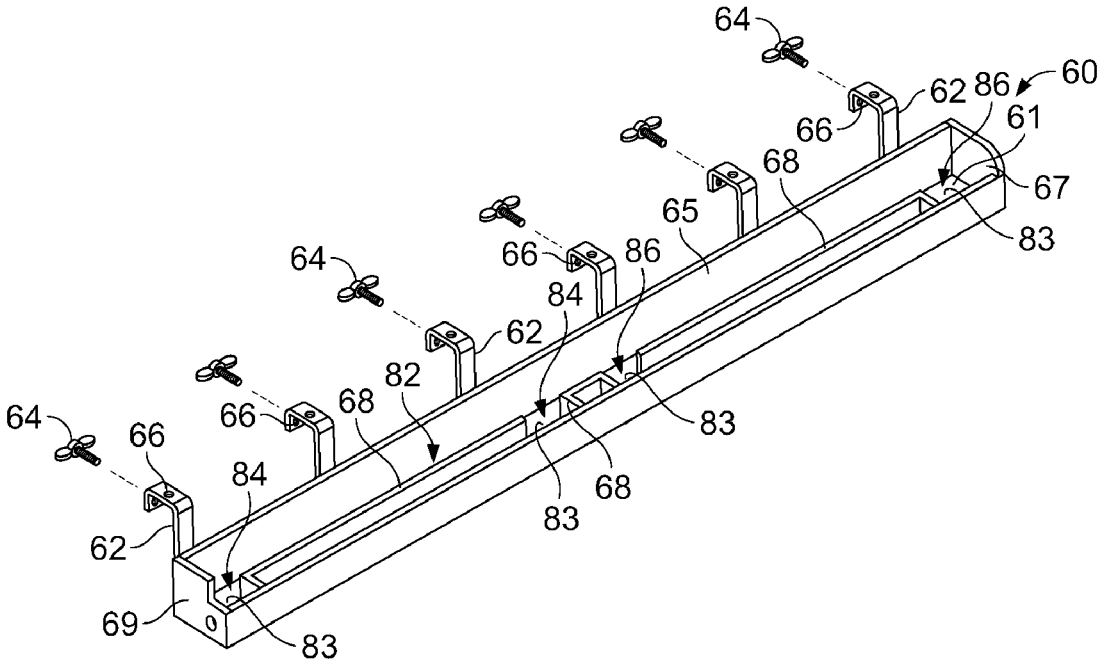
FIG. 4 illustrates a prospective view of a lower channel of the display assembly.

As may be seen in FIG. 3, the upper channel 50 includes a top wall 51, opposing upper side walls 53, 55, opposing upper end walls 57, 59 and a segmented divider wall 58 having a plurality of openings 70 defined therein. A longitudinal first upper track 72 is cooperatively defined by the top 51, upper side 55, upper ends 57, 59 and the divider 58 walls. A longitudinal second upper track 74 is cooperatively defined by the top 51, upper side 53, upper ends 57, 59 and divider 58 walls. The first and second upper tracks 72, 74 are oriented parallel and disposed immediately adjacent. The openings 70 each define a passageway between the first and second upper tracks 72, 74.

The lower channel 60 is adapted for connection to another of the beams 24 and is disposed substantially vertically aligned with the upper channel 50. The lower channel 60 includes a plurality of brackets 62 which facilitate connection of the lower channel 60 to the beam 24. As discussed above with respect to the upper channel 50, preferably, a plurality of threaded fasteners 64 engage a threaded aperture 66 to engage the beam 24 and thereby securely connect the lower channel 60 to the beam 24.

The lower channel 60 includes a bottom wall 61, opposing lower side walls 63, 65, opposing lower end walls 67, 69 and a plurality of interior walls 68. A longitudinal first lower track 82 is cooperatively defined by the bottom 61, side 65, opposing ends 67, 69 and plurality of interior 68 walls. The longitudinal first lower track 82 is substantially vertically aligned with the first upper track 72. The lower channel 60 further includes a plurality of stall sets 84, 86 oriented substantially transverse to the first lower track 82 where each stall 83 has an open end for communication with the first lower track 82.

The divider walls and interior walls of the upper and lower channels are preferably disposed and oriented such that the display panels are prevented from jumping tracks when being moved. Accordingly, jams and inoperative equipment is avoided.

Figure 6:
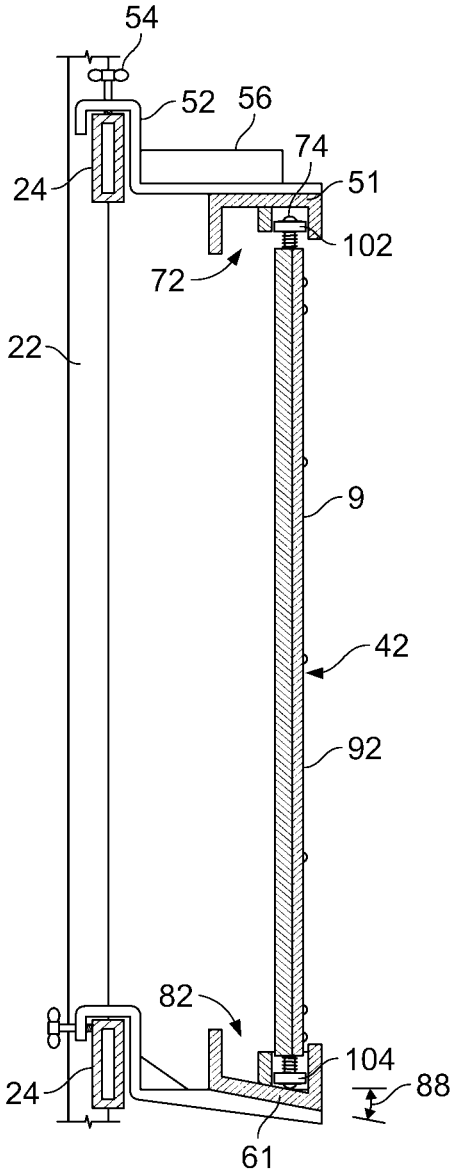
FIG. 6 illustrates a cross sectional view of the display assembly of FIG. 2 taken along line 6—6.
Figure 7:
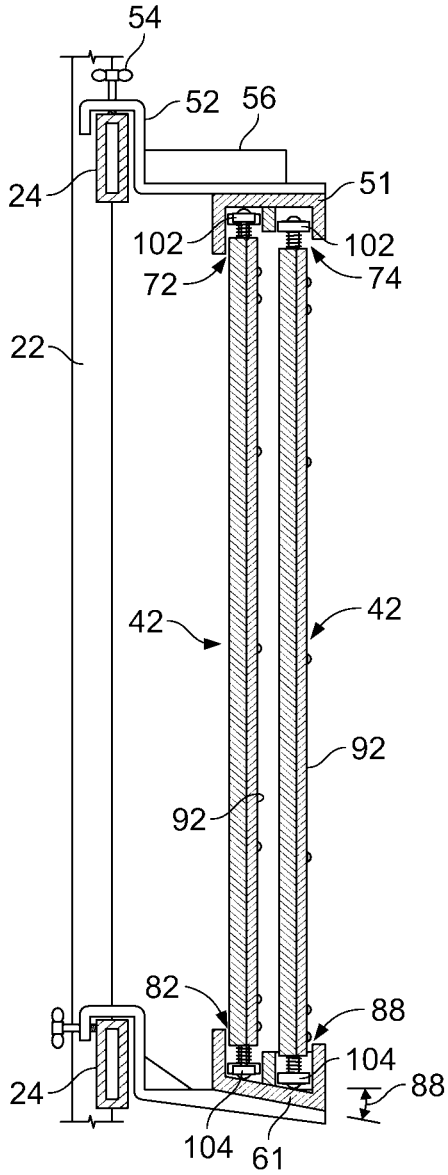
FIG. 7 illustrates a cross section view of the display assembly of FIG. 1 taken along line 7—7.

As may be seen in FIGS. 6 and 7, the bottom wall 61 is dispose oblique to the top wall 51. Included angle of such oblique orientation is identified by arrow number 88. It is within the teachings of the present disclosure that the included angle between the top wall 51 and the bottom wall 61, represented by arrow 88, is preferably in the range of approximately 2–12 degrees. However, it is within the teachings of this disclosure that the included angle may be more than 12 degrees, without an upper limit, if so desired.

One important advantage of this embodiment is an automatic return of a display panel to an open location and first operative position from a second operative position along the first upper and first lower tracks 72, 82 when a display panel is in registration with an open location, as will be discussed in more detail below.

Figure 5:
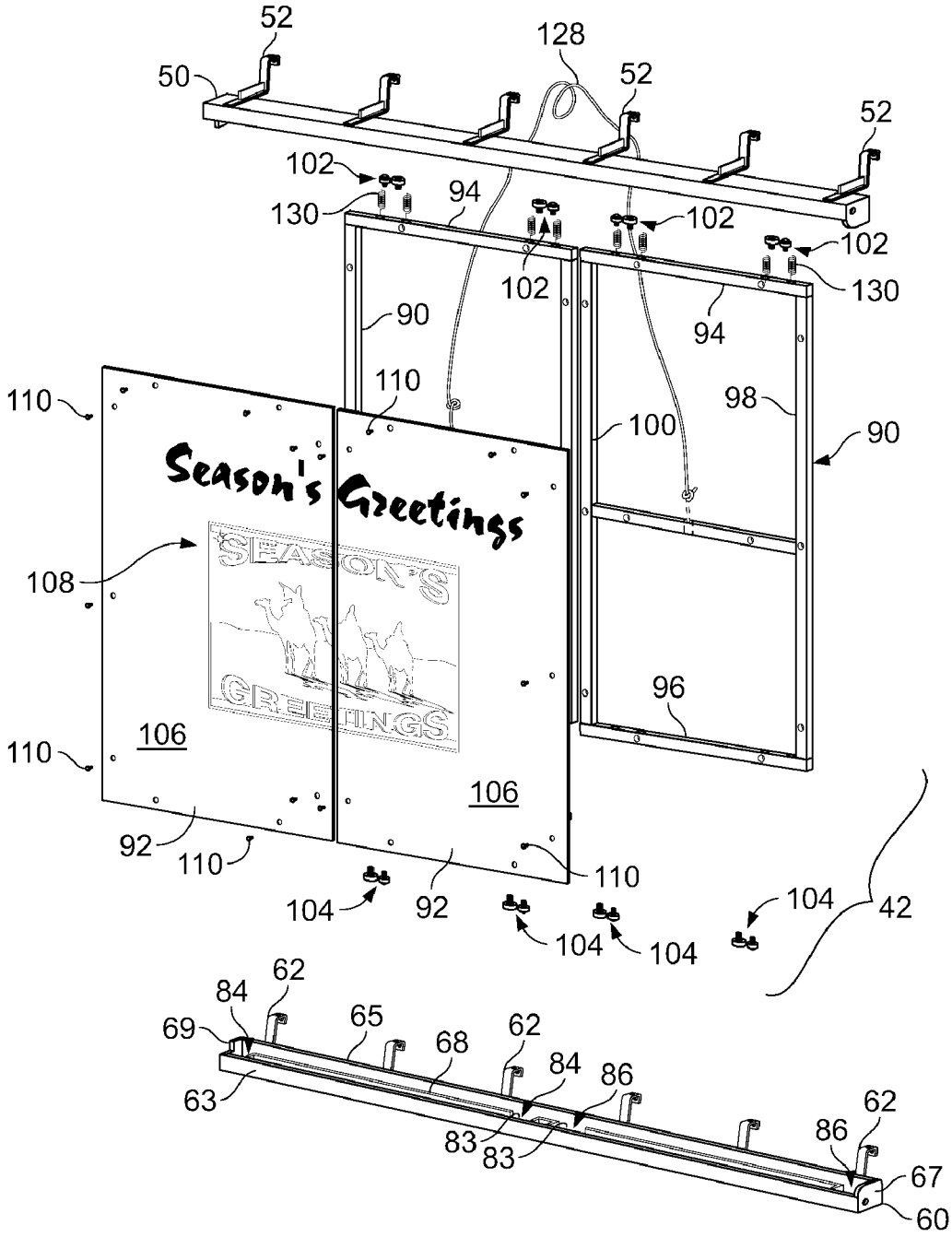
FIG. 5 illustrates an exploded view of the display assembly.

As may be seen in FIG. 5, each display panel 42 includes a frame 90 and a covering 92. The frame 90 has a top 94, bottom 96 and a pair of opposing sides 98, 100 extending between the top 94 and bottom 96 to define a periphery of the frame 90. Each frame 90 further includes a plurality of top guide elements 102 disposed at space locations on the top 94 of the frame 90. Bottom guide elements 104 are disposed at space locations on the bottom 96 of each frame 90. The top and bottom guide elements 102, 104 may be selected from the group consisting of ball transfers, wheels and the combination of ball transfers and wheels. In this embodiment, each top and bottom guide element 102, 104 includes a ball transfer and a wheel. It is within the teachings of the present invention that any other suitable device may be used as a guide element. For example, any other suitable device which enables the display panels to be movable relative to one another when in contact with the respective upper and lower channels 50, 60 may be a suitable device. Biasing members 130 may be disposed between the top guide elements 102 and the top 94 of the frame 90 which bias the top guide elements 102 away from the frame 90. It is within the teachings of the present disclosure that the biasing members 130 may be any suitable device with yields to an appropriate compressive force but forces the top guide elements away from the frame 90. For example, the biasing elements 130 may be formed as springs, compressible elements, rubbers, or any other suitable device. Such construction also facilitates ease of assembly of the display panels with respect to the upper and lower channels, in that the top guide elements may be disposed in the upper channel, the biasing members compressed and the bottom guide elements may be disposed in the lower channel.

A cable 128 may be provided as a safety device that prevents the display panels from falling in the event the display panel is inadvertently dislodged from at least the upper channel. The cable may be formed from any suitable substance. For example, the cable may be stranded metal, rope, synthetic material, natural material or any other suitable construction. The cable 128 is connected to an adjacent beam, preferably in a secure manner.

The covering 92 is configured generally equivalent to the periphery of the frame 90 and has an exterior surface 106 bearing at least a portion of a graphical representation 108. The covering 92 may be connected to the frame 90 by a plurality of fasteners 110 which may be any suitable device which connects the covering 92 to the frame 90.

It is within the teachings of the present disclosure that the graphical representation may be any form of indicia, advertising, picture, images, solicitations or any other design. Continuity of the design or graphical representation across a plurality of panels in an uninterrupted manner provides an aesthetically pleasing view to a consumer which entices such consumer to investigate the subject of the indicia, thereby, potentially increasing revenue to the retailer.

It is within the teachings of the present disclosure that the guide elements 102, 104 may be adjustably connected to the frame 90 in order to adjust for tolerances of different H-frame rack systems 20 when the display assemblies 40 are connected thereto.

Figure 2:
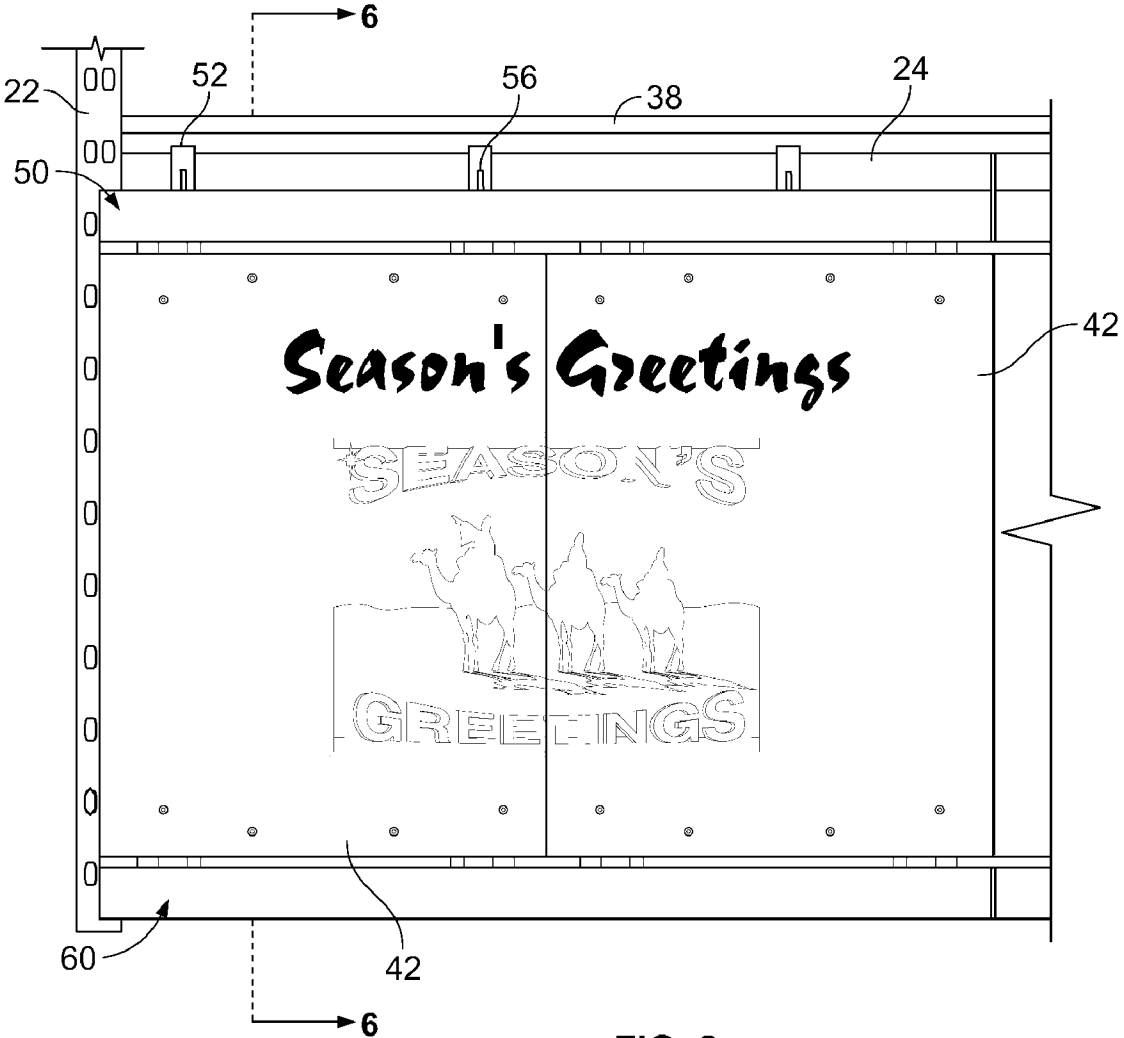
FIG. 2 illustrates a broken-away detailed view of a portion of the display assembly of FIG. 1.

In operation, the display panels 42 are initially disposed in a first operative position as may be seen in FIGS. 1, 2 and 6, where the bottom guide elements 104 of each display panel 42 are disposed in one of the stall sets and the top guide elements 102 are disposed in the second upper track 74 such that the coverings 92 of each display panel 42 are oriented coplanar and disposed nearly contiguous in order to cooperatively define a continuous, uninterrupted graphical representation rendered over the plurality of display panels 42. The display panels 42 are movable relative to one another. One display panel 42 may be moved independently with respect to the other display panel 42 from the first operative position to a second operative position offset parallel to the other display panels such that an open location is defined.

The second operative position is defined wherein such display panel 42, as may be seen in FIGS. 1 and 7, is disposed vertically aligned with the first upper 72 and first lower 82 tracks. When disposed in the second operative position, such display panel 42 may be moved from the second operative position longitudinally back and forth along the first upper 72 and first lower 82 tracks and may be subsequently returned to the second operative position so that when the one display panel 42 is in registration with the open location, the one display panel 42 automatically returns to the open location in first operative position. As discussed above, the included angle between the bottom walls 61 and 51, indicated by arrow 88, facilitates such automatic return. The interface of the ball transfers, wheels or combination thereof the included angle 88 and the way of the display panels 42 causes the display panel to automatically move from the second operative position to the first operative position in an open location. It is within the teachings of the present disclosure that the one display panel 42 as may be seen in FIG. 7, may be stored in contact with the first upper 72 and first lower 82 tracks to provide complete access to the merchandise stored there behind. Subsequent to the removal of such merchandise, such display panel 42 is preferably moved to the second operative position and further subsequently to the first operative position in the open location.

It is within the teachings of the present disclosure that a display assembly 40 may include more than two display panels. Accordingly, the upper 50 and lower 60 channels would be re-dimensioned scale wise to accommodate such configuration as would be recognized by one of skill in the art.

The automatic return of the one display panel 42 may be facilitated by alignment of the bottom guide elements 104 with one of the stall sets 84, 86 and the oblique orientation of the lower channel 60 with respect to the upper channel 50 such that a gravitation force moves the one display panel 42 to the open location substantially vertically aligned with the second upper track.

The covering 90 may be formed from any suitable material for bearing the graphical representation 108. For example, the covering 90 may be formed from a plastic, paper, natural, synthetic or other suitable material. Likewise, the frame is preferably formed from a metal. However, it is within the teachings of the present disclosure, that the frame may be formed from a plastic, natural, synthetic or other suitable material.

As may be seen in FIG. 8, the graphical representation may be a continuous representation over a plurality of panels. For example, the upper display assembly shows a graphical representation 108 which extends over four display panels 42 is within the teachings of the present disclosure that even larger display assemblies including more than four display panels may be used in connection with the present disclosure to achieve a continuous, uninterrupted graphical representation rendered over the plurality of the display panels. Such large display assemblies facilitate loading the shelves with oversized merchandise, in that many display panels may be moved to the second operative position and along the respective first tracks to define an oversized opening, i.e. longer than one display panel.

Furthermore, while the preferred embodiments have been shown and described, it will be obvious to those skilled in the art that changes in modifications may be made without parting from the teaching of this disclosure. The matter set forth in the foregoing description and accompanying drawings is offered by way of illustration only and not as limitation. The actual scope of the disclosure is intended to be defined in the following claims when viewed in their proper perspective based on the related art.

What is claimed is:

1. A display assembly for engaging a rack including a plurality of substantially vertical posts, a plurality of substantially horizontal beams connected to the vertical posts and substantially horizontal shelves supported by the horizontal beams, the display assembly comprising:

an upper channel adapted for substantially parallel connection to one of the beams including a longitudinal first upper track and a longitudinal second upper track, the first and second upper tracks oriented parallel and disposed immediately adjacent;

a lower channel adapted for substantially parallel connection to another of the beams disposed substantially vertically aligned with the upper channel including a longitudinal first lower track, a plurality of stall sets oriented substantially transverse to the first lower track where each stall has an open end for communication with the first lower track; and a plurality of display panels engaging the upper and lower channels, each display panel including a frame and a covering; the frame having a top, a bottom and a pair of opposing sides extending between the top and bottom which thereby define a periphery of the frame and a plurality of top guide elements disposed at spaced locations on the top of the frame and bottom guide elements disposed at spaced locations on the bottom of the frame; the covering configured generally equivalent to the periphery of the frame and having an exterior surface bearing at least a portion of a graphical representation; such that the display panels disposed in a first operative position, where the bottom guide elements of each display panel are disposed in one of the stall sets, the top guide elements are disposed in the second upper track and the coverings of each display panel are oriented coplanar and disposed nearly contiguous, cooperatively define a continuous, uninterrupted graphical representation rendered over the plurality of display panels.

2. The display assembly as recited in claim 1, wherein the display panels are movable relative to one another.

3. The display assembly as recited by claim 1, wherein one display panel is movable independently with respect to the other display panels from the first operative position into a second operative position offset parallel to other display panels such that an open location is defined.

4. The display assembly as recited in claim 3, wherein the one display panel in the second operative position is disposed vertically aligned with the first upper and first lower tracks.

5. The display assembly as recited in claim 3, wherein the one display panel may be moved from the second operative position along the first upper and first lower tracks and returned to the second operative position so that when the one display panel is in registration with the open location the one display panel automatically returns to the open location and first operative position.

6. The display assembly as recited in claim 5, wherein the automatic return of the one display panel is facilitated by alignment of the bottom guide elements with one of the stall sets and an oblique orientation of the lower channel with respect to the upper channel such that a gravitation force moves the one display panel to the open location substantially vertically aligned with the second upper track.

7. The display assembly as recited in claim 1, wherein the top and bottom guide elements are selected from the group consisting of ball transfers, wheels and the combination of ball transfers and wheels.

8. A display assembly for engaging a rack including a plurality of substantially vertical posts, a plurality of substantially horizontal beams connected to the vertical posts and substantially horizontal shelves supported by the horizontal beams, the display assembly comprising:

an upper channel adapted for substantially parallel connection to one of the beams including a top wall, opposing upper side walls, opposing upper end walls and a segmented divider wall having a plurality of openings defined therein, the top, upper side, upper end and divider walls cooperatively define a longitudinal first upper track and a longitudinal second upper track, the first and second upper tracks oriented parallel and disposed immediately adjacent, the openings each defining a passageway between the first and second upper tracks;

a lower channel adapted for substantially parallel connection to another of the beams, at a spaced location from the upper channel, including a bottom wall, opposing lower side walls, opposing lower end walls and a plurality of interior walls, the bottom, lower side, lower end and interior walls cooperatively define a longitudinal first lower track substantially vertically aligned with the first upper track, and a plurality of stall sets oriented substantially transverse to the first lower track where each stall has an open end for communication with the first lower track;

the bottom wall disposed oblique to the top wall; and a plurality of display panels movably engaging the upper and lower channels.

9. The display assembly as recited in claim 8, wherein each display panel includes a frame and a covering; the frame having a top, a bottom and a pair of opposing sides extending between the top and bottom which thereby define a periphery of the frame and a plurality of top guide elements disposed at spaced locations on the top of the frame and bottom guide elements disposed at spaced locations on the bottom of the frame; the covering configured generally equivalent to the periphery of the frame and having an exterior surface bearing at least a portion of a graphical representation; such that the display panels are oriented coplanar and disposed nearly contiguous, cooperatively defining a continuous, uninterrupted graphical representation rendered over the plurality of display panels.

10. The display assembly as recited in claim 8, wherein the display panels are disposed in a first operative position, substantially vertically aligned with the first upper track and one display panel may be moved independently with respect to the other display panels from the first operative position into a second operative position offset parallel to the other display panels such that an open location is defined.

11. The display assembly as recited in claim 10, wherein the one display panel disposed in the second operative position is vertically aligned with the first upper and first lower tracks.

12. The display assembly as recited in claim 11, wherein the one display panel may be moved from the second operative position along the first upper and first lower tracks and returned to the second operative position so that when the one display panel is in registration with the open location the one display panel automatically returns to the open location and first operative position.

13. The display assembly as recited in claim 12, wherein the automatic return of the one display panel is facilitated by alignment of bottom guide elements with one of the stall sets, alignment of top guide elements with adjacent passageways and the oblique orientation of the bottom wall with respect to the top wall such that a gravitation force moves the one display panel to the open location substantially vertically aligned with the second upper track.

14. The display assembly as recited in claim 9, wherein the top and bottom guide elements are selected from the group consisting of ball transfers, wheels and the combination of ball transfers and wheels.

15. The display assembly as recited in claim 8, wherein an included angle between the top wall and bottom wall is at least approximately 2 degrees.

16. A display assembly for engaging a rack including a plurality of substantially vertical posts, a plurality of substantially horizontal beams connected to the vertical posts and substantially horizontal shelves supported by the horizontal beams, the display assembly comprising:

an upper channel adapted for substantially parallel connection to one of the beams including a top wall, opposing upper side walls, opposing upper end walls and a segmented divider wall having a plurality of openings defined therein, the top, upper side, upper end and divider walls cooperatively define a longitudinal first upper track and a longitudinal second upper track, the first and second upper tracks oriented parallel and disposed immediately adjacent, the openings each defining a passageway between the first and second upper tracks;

a lower channel adapted for substantially parallel connection to another of the beams, at a spaced location from the upper channel, including a bottom wall, opposing lower side walls, opposing lower end walls and a plurality of interior walls, the bottom, lower side, lower end and interior walls cooperatively define a longitudinal first lower track substantially vertically aligned with the first upper track, and a plurality of stall sets oriented substantially transverse to the first lower track where each stall has an open end for communication with the first lower track;

a plurality of display panels engaging the upper and lower channels, each display panel including a frame and a covering; the frame having a top, a bottom and a pair of opposing sides extending between the top and bottom which thereby define a periphery of the frame and a plurality of top guide elements disposed at spaced locations on the top of the frame and bottom guide elements disposed at spaced locations on the bottom of the frame; the covering configured generally equivalent to the periphery of the frame and having an exterior surface bearing at least a portion of a graphical representation; such that the display panels disposed in a first operative position, where the bottom guide elements of each display panel are disposed in one of the stall sets, the top guide elements are disposed in the second upper track and the coverings of each display panel are oriented coplanar and disposed nearly contiguous, cooperatively define a continuous, uninterrupted graphical representation rendered over the plurality of display panels; and the bottom wall disposed oblique to the top wall.

17. The display assembly as recited by claim 16, wherein one display panel is movable independently with respect to the other display panels from the first operative position into a second operative position offset parallel to other display panels such that an open location is defined.

18. The display assembly as recited in claim 17, wherein the one display panel in the second operative position is disposed vertically aligned with the first upper and first lower tracks.

19. The display assembly as recited in claim 17, wherein the one display panel may be moved from the second operative position along the first upper and first lower tracks and returned to the second operative position so that when the one display panel is in registration with the open location the one display panel automatically returns to the open location and first operative position.

20. The display assembly as recited in claim 19, wherein the automatic return of the one display panel is facilitated by alignment of bottom guide elements with one of the stall sets, alignment of top guide elements with adjacent passageways and the oblique orientation of the bottom wall with respect to the top wall such that a gravitation force moves the one display panel to the open location substantially vertically aligned with the second upper track.

21. The display assembly as recited in claim 16, wherein the top and bottom guide elements are selected from the group consisting of ball transfers, wheels and the combination of ball transfers and wheels.

* * * * *